United States Patent [19]

Johnson, deceased et al.

[11] Patent Number: 4,549,561

[45] **Date of Patent: * Oct. 29, 1985**

[54] COIN HANDLING MACHINE

[75] Inventors: Roy B. Johnson, deceased, late of Manchester, Tenn., by Wilma J. Johnson, legal representative; Victor G. Ristvedt, Manchester, Tenn.

[73] Assignee: Ristvedt-Johnson, Inc., Mt. Prospect, Ill.

[ * ] Notice: The portion of the term of this patent subsequent to Jul. 4, 1995 has been disclaimed.

[21] Appl. No.: 688,020

[22] Filed: Dec. 31, 1984

Related U.S. Application Data

[60] Division of Ser. No. 503,530, Jun. 13, 1983, Pat. No. 4,531,531, which is a continuation-in-part of Ser. No. 207,963, Nov. 18, 1980, Pat. No. 4,444,212, which is a continuation-in-part of Ser. No. 921,063, Jun. 30, 1978, Pat. No. 4,234,003, which is a continuation of Ser. No. 735,060, Oct. 22, 1976, Pat. No. 4,098,280.

[51] Int. Cl.[4] ..... G07D 3/00

[52] U.S. Cl. ..... 133/3 A; 133/8 R

[58] Field of Search ..... 133/3 A, 8 A, 1 R, 3 R; 209/915, 917; 198/392

[56] References Cited

U.S. PATENT DOCUMENTS 1,894,190 12/1920 Myers .
1,979,659 1/1928 Zierick .
2,231,642 7/1934 Seemel .
2,906,276 3/1956 Blanchette et al. .
2,977,961 12/1957 Buchholz et al. .
3,771,538 11/1973 Reis .
3,837,139 9/1974 Roseberg .
4,086,928 5/1978 Ristvedt et al. .

FOREIGN PATENT DOCUMENTS 2012863 3/1970 Fed. Rep. of Germany .

*Primary Examiner*—H. Grant Skaggs
*Attorney, Agent, or Firm*—Leydig, Voit & Mayer, Ltd.

[57] ABSTRACT

A coin sorter is provided comprising a rotatable disc with a resilient surface and a stationary disc having its first surface positioned proximate to the resilient surface of the rotatable disc. Coins placed between the two disc surfaces are pressed into the resilient surface by pressure from the stationary disc. Selected areas of the stationary disc are recessed so as to release coins from their pressed engagement with the resilient surface and thereby allow radial movement of the released coins in response to centrifugal force. The selected areas of the stationary disc which are recessed, guide the coins along a path which results in each denomination of coin escaping from between the two discs at different positions along the periphery of the stationary disc. Recesses and ridges are provided on the underside of the stationary disc which recirculate improperly aligned coins. In particular, a ridge is provided which recirculates misaligned coins to a recessed area which initially receives coins from the center opening of the stationary disc. Another portion of the recesses provides an ejection route for misaligned coins which leads the coins back to the recessed area which initially accepts coins into the area between the two discs.

11 Claims, 28 Drawing Figures

COIN HANDLING MACHINE

This is a division of application Ser. No. 503,530, filed June 13, 1983, now U.S. Pat. No. 4,531,531 which is a continuation-in-part of patent application Ser. No. 207,963, filed Nov. 18, 1980 now U.S. Pat. No. 4,444,212, entitled "Coin Handling Machine" which is a continuation-in-part of patent application Ser. No. 921,063, filed June 30, 1978, now U.S. Pat. No. 4,234,003 entitled "Coin Handling Machine" which, in turn, is a continuation of patent application Ser. No. 735,060, filed Oct. 22, 1976, now U.S. Pat. No. 4,098,280, entitled "Coin Handling Machine".

FIELD OF THE INVENTION

This invention relates to coin sorting machines and, more particularly, to coin handling machines employing a rotating disc for sorting coins.

BACKGROUND OF THE INVENTION

Some businesses, particularly banks, are often faced with a large amount of coin currency at the end of a business day, week, or month which must be organized, counted and recorded. To hand count and record large amounts of coins of mixed denominations requires diligent care and effort and demands much manpower time that might otherwise be available for more profitable and less tedious activity. To make counting of coins less laborious, machines have been developed which automatically sort to denomination a mixed group of coins. A complement to the automation of the coin sorting process is the resulting increased sorting speed. Improving the sorting speed of a sorter machine while maintaining reliability gives a single machine the ability to service a larger business activity and thereby reduce the cost of sorting. Moreover, equipment associated with coin sorters in an overall coin sorting operation, such as coin counters, are capable of operational speeds in excess of the coin sorter speed. Consequently, the coin sorter is a source of speed limitation in the process of sorting, counting and tallying coins.

SUMMARY OF THE INVENTION

It is an object of the invention to provide a coin sorter of simple construction, capable of sorting large numbers of mixed denomination coins at a high sorting rate.

It is also an object of this invention to provide a coin sorter which is relatively immune from jamming.

It is a further object of this invention to provide a coin sorter which successfully sorts coins at a high rate without causing substantial wear to the sorted coins.

In accordance with the invention a coin sorter is provided which sorts mixed denominations of coins. The coin sorter comprises a rotatable disc having a resilient surface and a stationary disc having its first surface positioned proximate to the resilient surface of the rotatable disc. The two discs are positioned sufficiently close such that coins placed between the two disc surfaces are pressed into the resilient surface by pressure from the stationary disc surface. Accordingly, coins cannot move on the rotatable disc and, as a result, they rotate with the rotatable disc. Radial movement of the coins is urged by centrifugal force from the coin rotation, but such movement is prevented by the coins pressed engagement with the resilient surface. Selected areas of the stationary disc are recessed so as to release coins from their pressed engagement with the resilient surface and thereby allow radial movement of the released coins in response to centrifugal force. The selected areas of the stationary disc which are recessed, guide the coins along a path which results in each denomination of coin escaping from between the two discs at different positions along the periphery of the stationary disc. A means is provided to remove the upper coin from stacked or shingled coin combinations. Particularly, the means may be an arcuate elastomer member which retards movement of the upper coin while allowing the lower coin to rotate freely. Alternately, the means may be a recess in the stationary disc whose entrance allows only single layer coins to enter the recess by sweeping the surface of the lower coin and recirculating any stacked and shingled coins removed thereby. Recesses and ridges are provided on the underside of the stationary disc which recirculate improperly aligned coins. In particular, a ridge is provided which recirculates misaligned coins to a recessed area which initially receives coins from the center opening of the stationary disc. A portion of the recesses in the stationary disc which guide correctly aligned coins are configured to be approximately equal to the largest diameter coin in order to facilitate correct coin alignment. Another portion of the recesses provide an ejection route for misaligned coins which leads the coins back to the recessed area which initially accepts coins into the area between the two discs. Yet another portion of the recesses in the stationary disc allow the smallest diameter coin denomination smooth and quick release between the two discs.

Although the invention will be described in connection with certain preferred embodiments, it will be understood that it is not intended to limit the invention to those particular embodiments. On the contrary, it is intended to cover all alternatives, modifications and equivalents that may be included within the spirit and scope of the invention as defined by the appended claims.

DESCRIPTION OF THE PREFERRED EMBODIMENTS

Figures 1, 2, 3, 4:
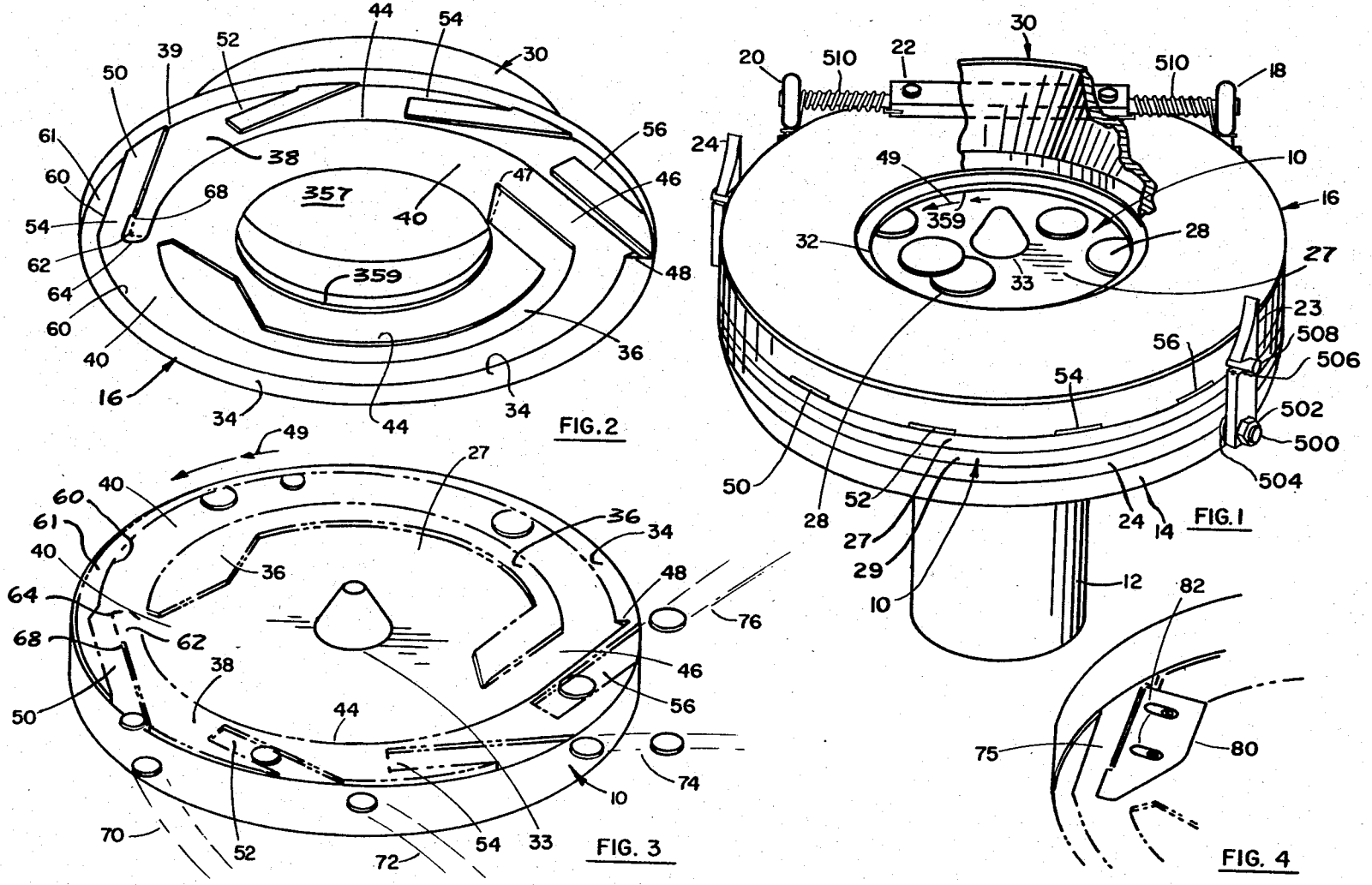
FIG. 1 is a perspective view of the coin sorter according to the invention.
FIG. 2 is a perspective view of the stationary disc of the coin sorter according to the invention showing a first embodiment of the invention.
FIG. 3 is a perspective view of the rotating disc of the coin sorter according to the invention illustrating in phantom lines the position of ridges and recesses on the underside of the stationary disc shown in FIG. 2.
FIG. 4 is a broken perspective view illustrating an adjustable coin release as contemplated by this invention.
Figure 22:
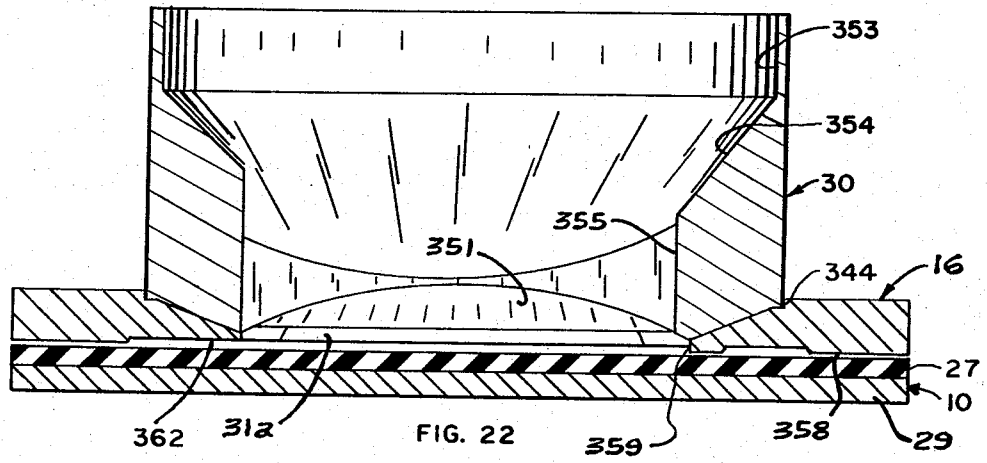
FIG. 22 is a sectional view taken along line 22—22 of FIG. 21.
Figure 16:
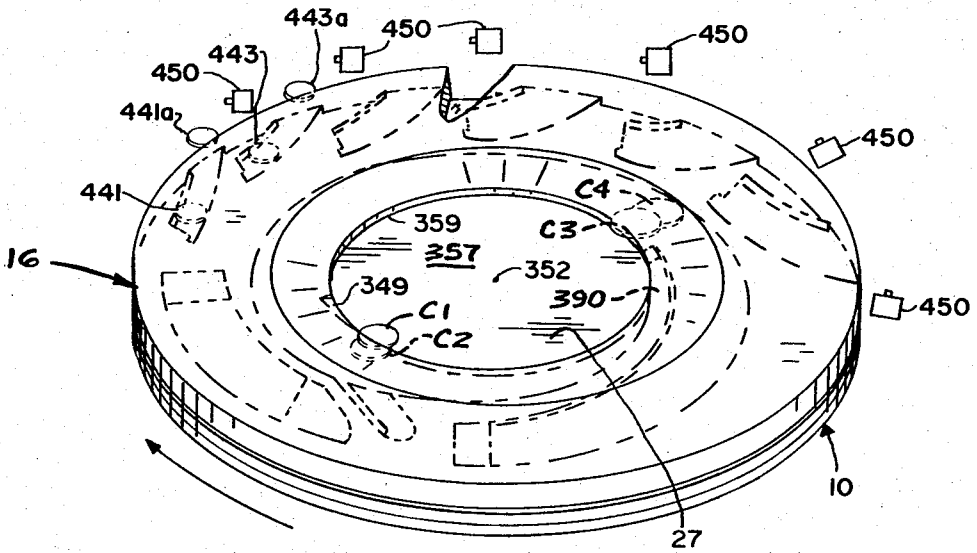
FIG. 16 is a perspective view of the rotating disc and stationary disc of FIG. 11 illustrating in phantom lines the ridges and recesses in the stationary disc.
Figure 21:
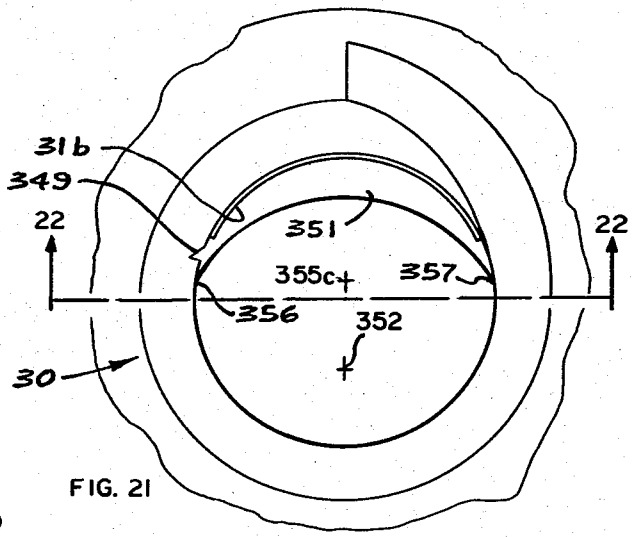
FIG. 21 is a bottom plan view of a portion of the stationary disc, showing the hopper as seen from such a view.
Figure 17:
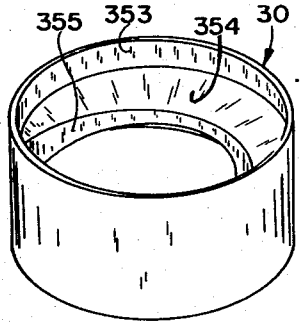
FIG. 17 is a lowered perspective view of a coin hopper for use in connection with the coin sorter shown in FIG. 1.

Referring to FIG. 1, a rotating disc 10, of approximately 8 to 20 inches in diameter, is driven by motor 12, both being supported by a four point mounting assembly, being pivotally mounted on base 14 through pivot mounts or supports 18 and 20 by means of mounting bar 22 and by identical latches 23 and 24. Each of latches 23 and 24 are pivotally mounted on base 14 by a pin 500. Nut 502 on pin 500 provides a supporting collar for a latch, which latch is spaced from base 14 by spacer 504. When latched (as shown), a receptacle 506 of a latch (e.g., 23) fits closely over and under pin 508, which extends outward from stationary disc 26. Stationary disc 16 may be opened back by moving backward latches 23 and 24, whereby stationary disc 16 would pivot about supports 18 and 20 and movable to a vertical position, exposing the top surface of disc 10. A pair of springs 510, coupled between stationary disc 16 and supports 18 and 20, tends to bias the stationary disc upward, and thus there is provided protection against the stationary disc coming down on someone's fingers when raised. Disc 10 has an overlay of a pliable resilient surface 27 provided by an elastomer pad, the pad having a typical thickness of from 0.2 to 0.4 inches. This pad, supported on plate 29 of disc 10, typically would have a firmness of 5 to 10 in the firmness scale employed for sponge material. Coins 28 are supplied to the sorter through a hopper 30 (FIG. 1) as illustrated in FIGS. 16 and 17, the hopper being supported in a support groove around an opening 32 in stationary disc 16 (FIGS. 1 and 22).

As can be seen in FIGS. 1, 2, 5, 6, 11, 16 and 23, the stationary disc 16 has a central opening 357 which exposes a portion of the resilient pad 27 wuch that coins dropped from the hopper 30 land onto the resilient pad 27 of the rotating disc 10. Because the coins tend to move on the rotating disc in a spiraling orbit, the central opening 540 is circular in shape in order to allow for this natural movement.

When the coins are dropped onto the exposed central surface portion of the rotating disc 10, they react to the centrifugal force, imparted on them by the rotating disc, by moving toward the annular side wall 359 of the central opening 357 cut in the stationary disc 16. Simultaneously and in combination with this outward movement the coins are carried by the rotating disc 10 in an orbit about the disc's rotational center. Together these movements describe an outwardly spiraling orbit as viewed from the perspective of a stationary observer. When a coin's edge reaches the annular side wall of the central opening, its outward movement is restrained by the annular side wall 359.

In all the embodiments of the invention the annular side wall of the central opening includes a recess which, for most denominations, allows single coins, but not multiple layered coins, to slide under the stationary disc. Stacked or shingled coins of some of the thinner denominations can be received into the recess. For these stacked thinner denominations the top coin is removed in a manner that will be explained in detail later in connection with FIGS. 13 and 16–23.

The coins which slide into the area between the two discs are captured by a series of ridges and recesses in the stationary disc and are guided by these ridges and recesses to predetermined destinations. Due to cooperation between the resilient surface of the rotating disc and the ridges and recesses of the stationary disc, the coins' radial movements are, in part, guided by alternately pressing the coins into the rotating disc and releasing them as the rotating disc carries the coins in an orbit under the stationary disc. As a complement to this, edges composed of junctions between ridges and recesses guide the orbit of the coins by creating barriers to the radial movement of the coins. The recesses and ridges of the stationary disc are strategically positioned along the rotational path of the coins so as to utilize the centrifugal force imparted on the coins by the rotating disc in such a way as to sort the coins by denomination.

A useful way to describe the functional interrelationship of the rotating disc and stationary disc is to view the stationary disc as a guiding mechanism. If the stationary disc were removed from its position proximate to the surface of the rotating disc, coins placed on the rotating disc would exhibit an orbital path having a constant radial component as a result of the unhampered centrifugal force acting on the coins. As a result, the coins would be flung off the rotating disc surface in a haphazard manner. The stationary disc serves to controllably guide the radial movement of the coins and thereby impart to the coins a controlled orbit which steadily increases. While on route in this controlled outwardly spiraling orbit or arcuate path, the coins are sorted by the guiding action of the stationary disc.

Each area of ridges and recesses in the stationary disc guides the coins in a particular manner to prepare the coins for the journey to, and manipulation by, a following area of ridges and recesses. The ridges and recesses in the surface of the stationary disc provide two types of guiding action. In the first type of guiding, an edge or side wall, defined by a combination of a ridge and recess, serves as a guide surface for the edges of the coins which are urged against the side wall by centrifugal force. In the second type of guiding, the ridges and recesses press the coins into the resilient pad to prevent coin movement relative to the pad surface. As a result, the coins rotate with the pad to define an arc length of a circular orbit.

When coins are brought into one of the second type of guide areas of the stationary disc by way of the rotating disc, the coins are pressed into the resilient surface of the rotating disc. Consequently, the coins do not move relative to the surface of the resilient pad 27 and the rotating disc 10. But relative to the stationary disc 16, these coins move in an orbit about the center of the rotating disc without changing their radial distance from the center. By selective guiding of the coins by the stationary disc in the two ways mentioned, the coins are carried in an outwardly spiral orbit on the resilient surface of the rotating disc which segregates the coin by denomination as will be explained more fully below.

As the coins are carried on the rotating disc their path comprises two well defined movements between the surface of the stationary disc and the rotating disc. If the coins are kept pressed into the pad by the ridges of the stationary disc, the coins will not move radially under the influence of centrifugal force, but will be carried on the resilient pad at a constant radius to define a circular orbital path about the center of the rotating disc. If during their orbit the coins are brought into a recess in which the coins are not pressed into the pad, the coins will move outwardly on the pad in response to centrifugal force, thus giving the coin orbit a radial component which moves the orbit farther out from the disc center until the orbit's radial component is met by an edge of a ridge-recess combination in the stationary disc. As long as the coins are not pressed into the resilient pad 27, they will remain against the stationary disc edge as they continue to orbit.

In short, the recesses and ridges in the bottom surface of the stationary disc take advantage of the natural movement of the coins as they orbit to position the coins at particular disc radii which align their orbits so that recesses in the stationary disc encountered by the rotating coins will selectively exit the coins from between the two discs.

Referring to FIGS. 2 and 3, a first embodiment of the stationary disc is illustrated. It will be noted that the underside of stationary disc 16, which is generally flat, has three downwardly extending guides, being peripheral limit guide 34, single file guide 36, and coin release guide 38. Stationary disc 16 is positioned with respect to rotating disc 10 such that these guides extend down to close proximity with the top flexible surface 26 of disc 10, such that coins in-between the two discs are pressed into the resilient surface 27. Regions 40 have a clearance in which coins are free to move unimpeded by the guides. Thus, the guide surfaces generally have a thickness, as measured from regions 40, of approximately 0.08 to 0.085 inches, corresponding generally to the thickest coin to be sorted.

Referring to FIG. 3, guide 36 functions to route coins from the central region of disc 10 and pad 27 radially outward over a limited peripheral region of approximately 180°, where they would be stopped by an inner wall 44 of guide 38, and then as they are rotated, they would pass through a single file passageway 46 to form a single file on peripheral limit guide 34, this guide having a tapered edge 48 which effects a wedge action on the coins, stabilizing their movement against radial bounce, causing the coins to be moved circumferentially in a spaced format as shown about disc 10. Coins reaching passageway 46 which are not against inner wall 44, and thus not in a single file, are captured by tapered edge 47 (similar to that shown in FIG. 10), pressed into pad 27, and rotated back into the center of disc 10. Double layers of coins are prevented in the passageways between guides by maintaining a clearance (0.08 to 0.085 inches) between the resilient surface 27 of disc 10 and the region 40 of stationary disc 16 of less than the double thickness of the thinnest coins to be sorted; that being in the present case, dimes, which have a thickness of about 0.05 inches each.

The coins continue in the circular direction indicated by arrow 49 until they reach coin release guide 38. As shown, coin release guide 38 contains four coin release slots, coin release slot 50 for dimes, coin release slot 52 for pennies, coin release slot 54 for nickels, and coin release slot 56 for quarters. The slots or recesses comprise discrete or selected recessed areas in stationary disc 16 and are of a width equal to or slightly larger than the diameter of the coin denomination they are intended to receive. As shown, the coins encounter progressively larger slots as they are rotated by disc 10 counterclockwise under coin release guide 38 by being compressed between the guide 38 and the resilient surface 27 of disc 10. When a coin encounters a recess large enough to accept its diameter it is guided by the recess to an exit point.

Assume first that a dime is the first coin in line approaching coin release guide 38, it having its outer edge against the inner edge 60 of turned-in guide extension 61 of guide 34. The coin thus engages with its inner edge the outer leading edge 62 of guide 38, which edge is tapered upward to gradually depress a coin and seize it. Thus, from points 64 to 68, the coin is wedged in a stabilized radial position until it reaches the full dime width of dime slot 50, where it is freed of vertical restraint and is thus free to follow the outwardly extending path of slot 50, which extends essentially normal to a radial line and thus to the edge of disc 10, enabling a dime to be ejected at a peripheral position or path 70, at which a coin sorting bag or outer receptacle (not shown) would be positioned.

Assume next that a larger coin, say, a penny, arrives at and strikes leading edge 62 of guide 38. Such coin will be captured by the outwardly leading edge 62 of guide 38 between points 64 and 68 and continue to be captured by virtue of the fact that the inner edge of the coin will be forced inward of the inner edge of dime slot 50 by edge 60, and thus be wedged between the resilient surface 27 and guide 38. This will cause the coin to be moved in a path of constant circumference rather than to be free to move outward. The rotary movement of the coin continues until it strikes penny slot 52, and since slot 52 is of a width to accommodate a penny, a penny will be released from vertical pressure, and, by virtue of its momentum, it will be hurled outward in slot 52 along a path 72 where it would be intercepted by a penny sorting bag or receptacle (now shown). In a similar manner, larger coins, for example nickels and quarters, would be captured and sorted by slots 54 and 56, respectively, being intercepted by bags at path positions 74 and 76, respectively.

FIG. 4 illustrates a coin release slot 75 formed by an adjustable guide member 80, which is movable in adjacent slots 82 to enable a coin release slot to be formed of any desired width. Such an adjustable coin slot assembly may be positioned as the first, intermediate, or last slot in a series, depending upon a desired range of adjustment. Similarly, it may be the only slot in an assembly where, for example, the sorter is to be employed as a coin verifier wherein it is only necessary that coins be routed in a single file from the device, enabling them to be hurled into space in a single file where they can readily be counted by optical, electrical, or other conventional counting means.

Figures 5, 6, 7, 8, 9, 10:
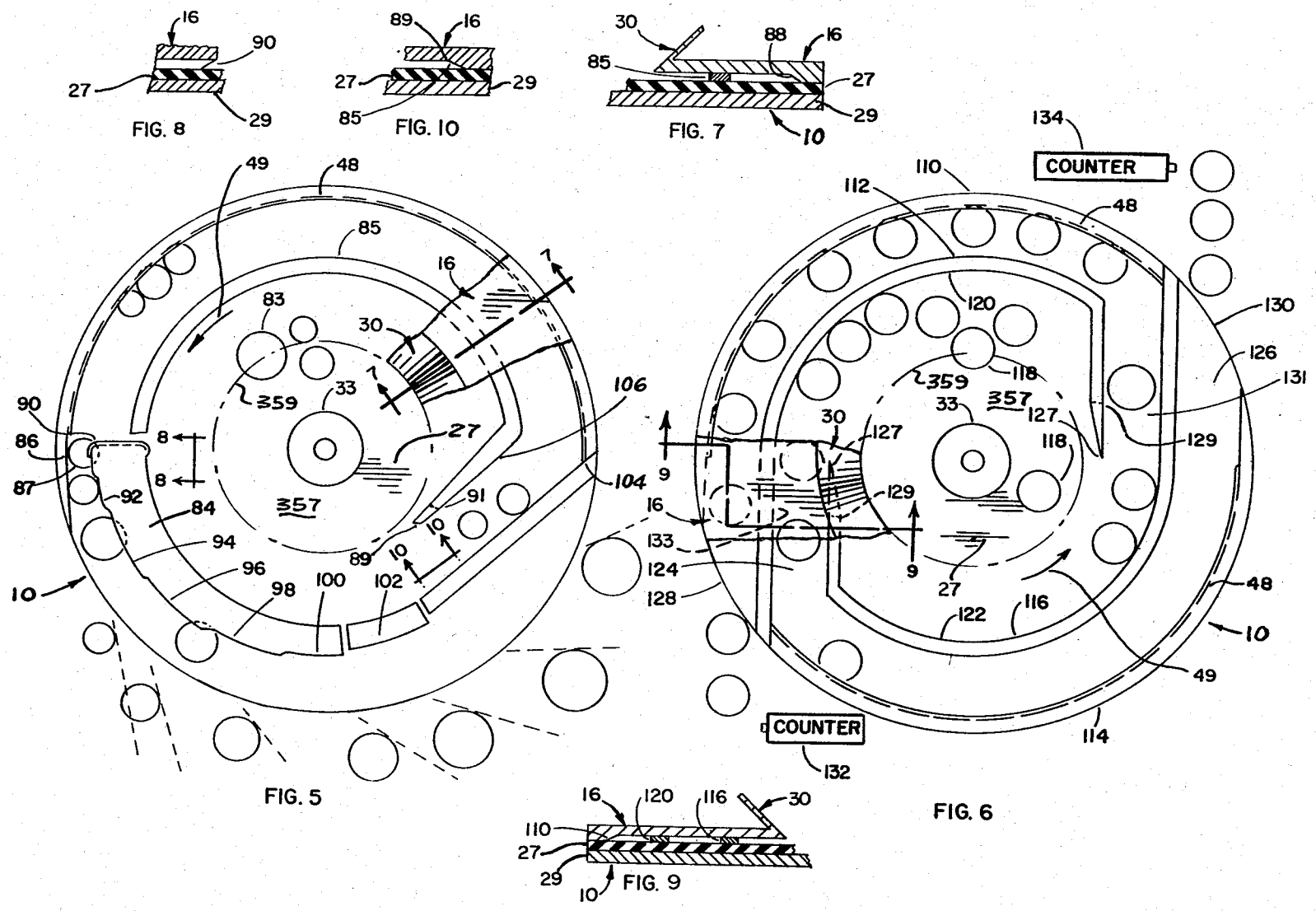
FIG. 5 is a plan view of the stationary disc showing a second embodiment of the invention.
FIG. 6 is a plan view of a third embodiment of the stationary disc, particularly useful for coin count verifying.
FIG. 7 is a sectional view taken along line 7—7 of FIG. 5.
FIG. 8 is a sectional view taken along line 8—8 of FIG. 5.
FIG. 9 is a sectional view taken along line 9—9 of FIG. 5.
FIG. 10 is a sectional view taken along line 10—10 of FIG. 5.

FIGS. 5–10 illustrates a second embodiment of the stationary disc 16. FIG. 5 shows the stationary disc 16 as it would be seen if viewed in section looking vertically downward on the apparatus in FIG. 1. Generally, circular guide member 85, shown in cross-section in FIG. 7, blocks the exit of coins from the center of disc 10 except through a single file passageway 87, leading edge 89 thereof being tapered, as shown in FIG. 10, to capture any coins tending to be stopped by the leading edge of guide 85, causing any such coins to be rotated back into the center of disc 10.

The basic change illustrated by this embodiment of the invention is in the form of the coin release guide, illustrated by coin release guide 84. The leading edge 90 of this guide is illustrated in FIG. 8, illustrating that a coin carried in the direction 49 on pad 27 would be forced down into pad 27 and be captured and rotated in an arc having a constant radius. FIGS. 7 and 8 also illustrate that pad 27 is supported on circular disc 29, typically secured in place by conical hub 33 (shown in FIG. 5).

In contrast to guide 38 shown in FIG. 3, guide 84 of FIG. 5 has only a series outer edge of progressively radially shorter radii. Thus, for example, a dime 87 would be captured between outer guide 86, an extension of peripheral stop guide 48, and leading edge region 90 of guide 84 until the dime reaches the indentation 92, at which point a dime would be freed from restraint and would be hurled outward in the same manner as described above.

Coins larger than a dime would be initially secured in the same manner and would continue rotation in a circular pattern on disc 10 until released by one of the coin release indentations 94, 96, 98, 100, 102 or 104, each being of progressively shorter radius to progressively release larger coins as the coins counterclockwise. If desired, the device may be made to operate clockwise by reversing the arrangement of the guides.

The actual number and location of the outer edge radii of the guide 84 are dependent upon the number and diameter of coin denominations to be released. It is only necessary that the dimension between guide edge 90 and guide edge 86 be smaller than the smallest coin to be released in order to initially capture a coin. Coin release 102 is shown as being discrete from coin release guide 84 as an example of a removable or an interchangeable guide to accommodate a selected coin size greater than the size released by release edge 100. Coin release 104 also serves as an extension of guide 84 to prevent coins from escaping from the center of the sorter except by the release route described. Guide 106 guides coins from the center of disc 10 onto the inner edge of guide 48 to form a single file as in the case of guide 36 of the embodiment shown in FIGS. 2 and 3.

In a third embodiment of the invention, FIG. 6 illustrates a coin verifier, a device which functions to arrange coins in a single file and then count them, the purpose being to determine the accuracy of a count of coins in some container. A device of the type illustrated in FIG. 6 would have the same drive system, rotating disc, top supporting plate, and hopper as shown in FIG. 1. This general arrangement is partially illustrated in the sectional view shown in FIG. 9 illustrating the relationship of hopper 30, stationary disc 16, and pad 27 on steel rotating disc 29 which comprise disc 10. The guide configuration is different, as shown in FIGS. 6 and 10.

FIG. 6 shows the downward extensions of disc 16 which form, in this case, peripheral limit guides 110 and 114, which are identical but opposite, and inner guides 112 and 116, also being identical but opposite. Thus, as shown, coins 118 placed on disc 10, through hopper 30, would radiate outwardly against inner edges 120 and 122 of guides 110 and 116 respectively, and then would be routed through passageways 124 and 126 to form a single file which is edged against flexible pad 27 by guides 110 and 114, having a tapered configuration 88 as shown in FIG. 9. This prevents bounce and increases the speed of operation. Thus, coins would be rotated in a single file until they come to exits 128 and 130, where they would be hurled along a line outwardly to be intercepted or passed by counters 132 and 134, which would count them.

Identical leading edges 127 of guides 112 and 116 are tapered back to point 129 similar to the tapering of guide 85, as shown in FIG. 10, so that any tendency of two coins wedged together between guides at the entrance to passageways 131 or 133 is prevented by the inner of such coins being captured under this tapered edge of the guide and the coin rotated back into the center region of the disc. A counter may be of a type employing light, radiation, magnetic, or another form of conventional sensing to effect counting. After leaving counters 130 and 132, coins would be fed to coin bags (not shown).

While the coin verifying device shown in FIG. 6 illustrates two verifying paths, a single one may be effected by making guides 110 and 114 continuous, omitting, for example, passageway 126 and making guides 116 and 112 circularly continuous and leaving a single exit 128.

It will be appreciated that, in contrast to previous verifiers, the verifier shown in FIG. 6 needs no adjustment to verify different size coins. Further, by making the counters selective insofar as the denomination of coin counted is concerned, a monetary value count of coins passing through the verifier may be achieved, or the detection of "off" denomination coins which were unintentionally mixed may be achieved.

FIGS. 11–16 illustrate a fourth embodiment for a stationary disc, and FIGS. 17–22 particularly illustrate a coin hopper 30.

Hopper 30 has a round exterior which fits within a circular groove of stationary disc 16 (FIG. 16) concentric with the center point 352 of rotating disc 10 (FIG.

Figure 20:
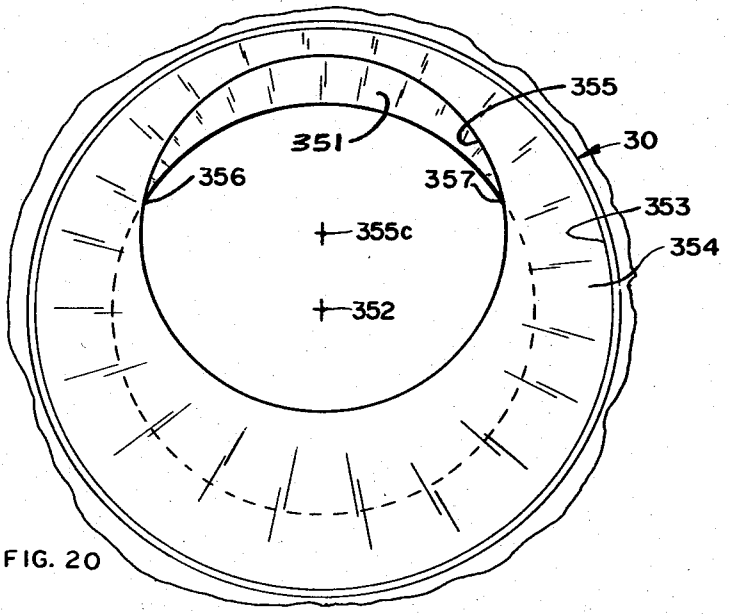
FIG. 20 is a top plan view of the coin hopper of FIGS. 17–19 as installed on the coin sorter with a portion of the stationary disc on which it is mounted broken away.
Figure 18:
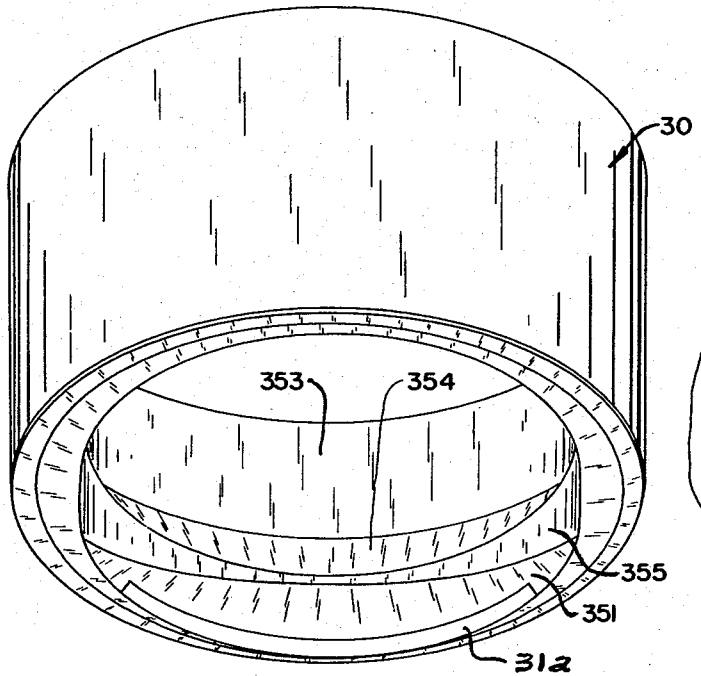
FIG. 18 is a raised perspective view of the coin hopper shown in FIG. 17.

11). Referring to FIG. 16, a top inner edge region 353 of the hopper, which is concentric with the center point 352, provides an entrance region for coins. A tapered region 354 of the hopper extends continuously downwardly and inwardly from the top region. It is interrupted by cylindrical cut region 355 which is offset, having a center point 355*c* (FIG. 20).

Referring back to FIG. 11, this cylindrical cut region provides a final exit from the hopper to disc 10, from which the coins migrate under stationary disc 16, to be sorted as described above. An underside region 351 (FIGS. 18, 21 and 22) of the cylindrical offset portion of the hopper is tapered, extending along an arcuate length from point 356 to point 357 in FIG. 20. The tapered region in conjunction with the offset of the cylinder portion of the hopper causes any coin which might tend to stand up on its edge as it moves around hopper 30 with a group of coins, to be flipped over to a normal, flat position on pad 27.

Figures 11, 12, 14:
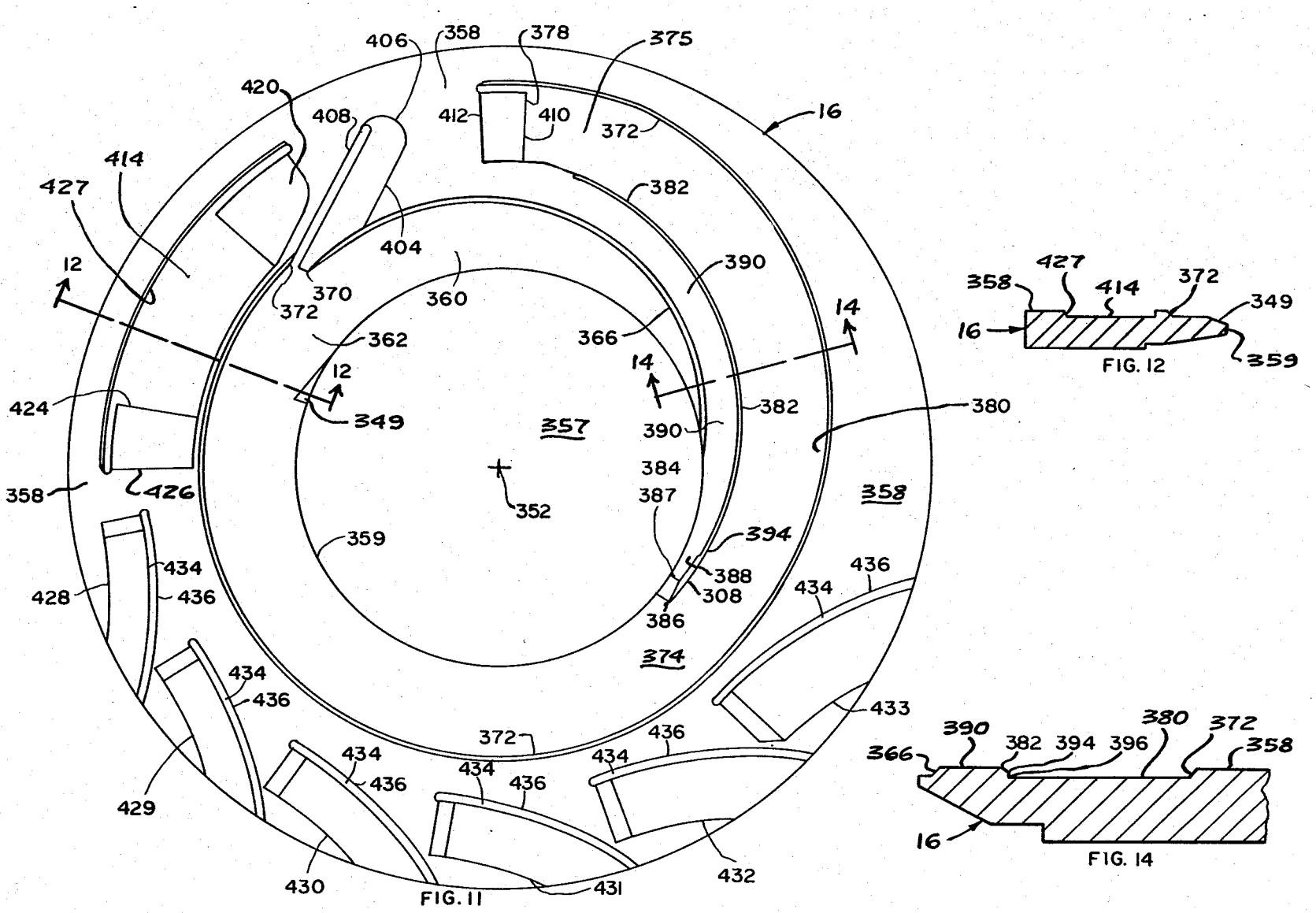
FIG. 11 is a plan view of the underside of a stationary disc showing a fourth embodiment of the invention.
FIG. 12 is a sectional view taken along line 12—12 of FIG. 11.
FIG. 14 is a sectional view taken along line 14—14 of FIG. 11.
Figure 13:
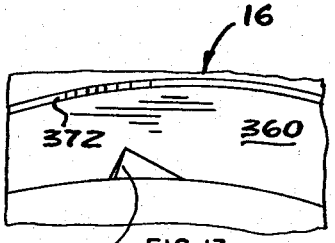
FIG. 13 is a fragmentary plan view of a portion of the stationary disc shown in FIG. 11, particularly illustrating the configuration of a notch employed to separate shingled coins.

As one feature of the invention, stationary disc 16 provides means of preventing shingling of coins, that is, means for preventing the condition in which one coin rides on the rotating disc over another coin, a condition which typically occurs at edge 359 (FIGS. 11 and 16). Referring to FIG. 16, there are illustrated shingled coins C1 and C2, wherein coin C1 is riding partially on top of coin C2. With disc 10 moving in the direction of the arrow, the top coin, C1, is engaged by notch 349, temporarily stopping it and allowing coin C2 to be rotated free, and thus the two coins separated.

Figure 19:
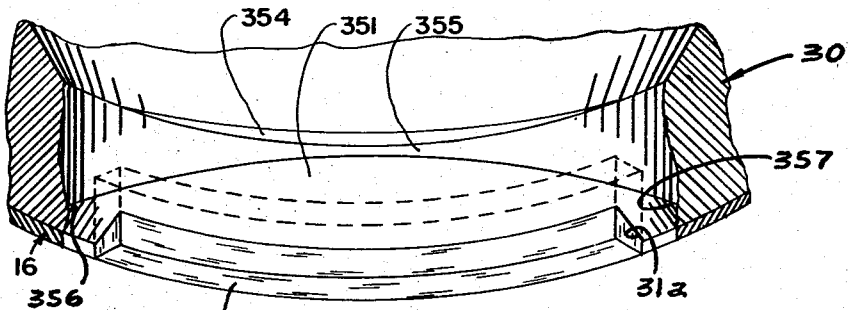
FIG. 19 is a fragmentary raised perspective view of an inside lower portion of the coin hopper in FIGS. 17 and 18, illustrating the inclusion of a resilient anti-shingling device.

An alternate means of preventing shingling is illustrated by the addition to hopper 30 of an arcuate slot 31*a* (FIG. 18) into which, as shown in FIG. 19, there is inserted a resilient member 31*b*, extending downward to a plane coinciding with the plane of the adjacent underside of stationary disc 16. Resilient member 31*b* is an elastomer, such as neoprene, and provides significant friction to a coin when pressed into its surface. In operation, when the top coin of two coins which are shingled presses upward against member 31*b*, there is a frictional effect on it which applies a drag, slowing its movement, and thus allowing the lower of the coins to be rotated on pad 27 (FIG. 22) from under the top coin.

Referring now to FIG. 11, and keeping in mind that this figure shows a bottom view of stationary disc 16, the stationary disc 16 has a flat, rigid, lower surface 358, positioned closely adjacent to the surface of pad 27, as shown in FIG. 22. There is a generally spiral-shaped recess 360 in lower surface 358, and this recess, extending approximately 0.065 inches above lower surface 358, commences at a point 384 at the edge 359 of central opening 357. The recess is bordered by a tapered (45°) edge 366 and generally widens in an outward spiral, which extends angularly (counterclockwise as viewed) about center point 352 for approximately 120° to point 370. From point 370, recess 360 with tapered (45°) guide edge 372 as an outer edge, is essentially of a constant width of approximately 1-5/16 inches around disc 16 for approximately 180° to area 374. From point 374, recess 360 extends in an outward spiral for approximately 130° to area 375 adjacent to down ramp 378. The latter spiralled portion of recess 360 is of a width just sufficient to accommodate the diameter of a single coin of the largest diameter of coin to be accommodated, e.g., 1.215 inches for a U.S. 50-cent piece, which has a diameter of 1.205 inches, and this portion of recess 360 is particularly referred to as single file track 380.

Recess 360 forms a single file track for coins by way of its inner side 382 and outer edge 372. Protrusion 390, which is an extension of lower surface 358 extends counterclockwise from point 386 in an outward spiral, and terminating near ramp 378, into lower surface 358.

Protrusion 390 has a front tapered region 388 (tapered to fall 0.065 inches in 5/16 inches from point 386 to point 387) at the entrance of single file track 380, with the tapered region functioning to smoothly and completely radially capture coins which do not freely pass on either side of it. To facilitate radial capture of coins which have entered track 380 but have stopped radially short of guide edge 372, the front outer edge region 308 of protrusion 390 is tapered from point 386 to point 392 at an angle of 45° from track surface 380 to the surface of protrusion 390. This tapered edge region 388 of protrusion 390 functions to smoothly capture coins rotated into it.

Continuing counterclockwise along wall 382, and as shown in FIG. 14, wall 382 has a lower portion 394 (keeping in mind the inverted position of FIGS. 11 and 14), which is tapered at 45° and an upper portion 396 which is vertical. This combination enables the bottom coin C4 of two stacked coins C3 and C4 in FIG. 16, which are layered or shingled as shown, to be captured by protrusion 390 and then rotated (in the direction of the arrow) at the radial position of capture until the lower of the coins is freed inboard of protrusion 390.

Figure 15:
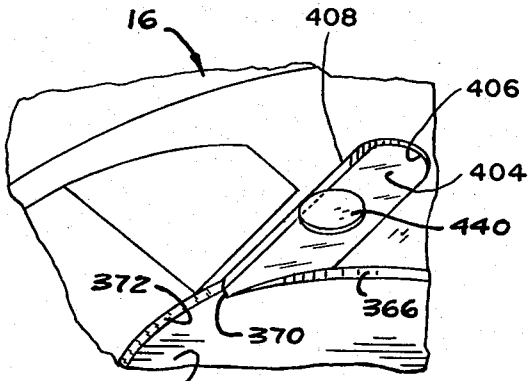
FIG. 15 is a fragmentary perspective view of a portion of the stationary disc shown in FIG. 11, illustrating a slot which functions to accept coins which are not properly aligned for sorting.

While it is the object of the structure thus far described to assure that coins passing through track 380 will arrive at ramp 378 in single file and will be positioned with their outer edge against guide edge 372, it is possible that a coin will rest edgewise on an adjacent coin which is against guide edge 372 and thus will not be correctly positioned. In order to take care of this contingency, and to assure sorting in accordance with the operation to be described, a slot 404 (FIGS. 11 and 15) is provided, which as its radially outer edge 406 radially interior (by approximately 3/16 inch as measured radially from guide edge 372). This slot, with vertical edge 408, extends inward at an angle of approximately 25° (with respect to a radial line intercepting it) to merge with recess surface 362, as illustrated in FIG. 15. Since radially outer edge 406 of slot 404 is radially inboard of guide edge 372, slot 404 will let pass and not catch coins which are radially aligned against guide edge 372 at the time they transit ramp 378. On the other hand, vertical edge 408 will catch coins which are significantly inboard of this radial position and cause them to pass along slot 404 inboard and be rerotated along track 380 to ramp 378.

A 45° taper on edge 366, from point 384 to 370, and on guide edge 372 tends to apply a downward force on coins striking these edges, which force is met by the resilient pad 27. As a result, there is provided a gradually increasing breaking force which tends to ease the impact of coins against the edges and therefore reduce coin bounce.

As will be appreciated from the above description and discussion, coins do not always make it to a position in single file along guide edge 372 by their initial outward radial movement. A significant number fall short, and these must be returned to the center region of pad 27 for another try. A problem in effecting this return is to accomplish it without jamming and without such severe impact on coins as to effect significant wear on them. In the case of the embodiment of the invention now under discussion, most coins being returned to the center of pad 27 are returned by radial capture accomplished by protrusion 390. Since capture is effected at tapered surfaces of protrusion 390 and by a gradual depression of coins into the surface of pad 27, there is a relatively soft impact between coins and protrusion 390 which contributes little wear.

When coins do reach a position with their outer edge precisely against guide edge 372 and are rotated through track 380 in this posture, they are next rotated under ramp 378, and thus radially captured by lower surface 358 at their then radial position. Ramp 378 tapers downward from track 380, starting around area 410 and continuing to the surface 358 at line 412. As shown, ramp 378 is spaced approximately 0.125 inches from tapered edge 372 for ease of manufacture.

Coins exiting ramp 378 are rotated, as captured, to gauge slot 414. Guage slot 414 functions to finally position coins before sorting. It is generally of arcuate shape and is recessed 0.100 inches into guide surface 358. Ascending ramp 420 of gauge slot 414 makes a gradual transition between the surfaces. Similarly, descending ramp 424 provides a gradual decline from the recess of gauge slot 414 to guide surface 358. Edge 427 of gauge slot 414 is tapered for the same reasons as edge 366 and edge 372 are tapered—in order to prevent bounce; but on the other hand, it is particularly important that coins come to rest at the same precise radial position in slot 414, and thus there is a lesser taper, approximately 17° (measured inward from a plane normal to guide surface 358) for edge 427, whereby coin thickness will have less effect on radial positions, thus enabling more precise radial gauging. Gauge slot 414 rises approximately 0.1 inch above guide surface 358, and thus coins in this slot are quite free to move radially over the pad surface and thereby precisely position themselves against edge 427.

In order to assure proper operation, the radial position of edge 427 is slightly outboard of edge 372 in track 380 (approximately 0.125 inch). This permits some radial slippage of coins as they are rotated between edge 372 and gauge slot 414 without their moving radially outward beyond gauge slot 414, which would prevent them from being rotated into and being aligned by gauge slot 414. Entrance ramp 420 and exit ramp 424 of gauge slot 414 are both inboard of gauge edge 427 by approximately 0.125 inches for ease of manufacture. Coins are rotated from gauge slot 414 by pad 27 and are radially captured as they pass down ramp 424 and make full engagement with guide surface 358 of stationary disc 16.

Coin release slots 428, 429, 430, 431, 432 and 433 are positioned from left to right in FIG. 11 in order of ascending width. The have an arcuate pattern and are positioned to intercept coins in generally the same fashion as described above with respect to embodiments of the invention illustrated in FIGS. 2 and 5. Thus, slot 428 is radially positioned to intercept the smallest diameter of coin to be sorted, and coin release slot 433 is radially positioned in intercept the largest of coins to be sorted. Each slot is of a height and radial width to accommodate a selected coin denomination.

It will be appreciated that the coin release slots of this embodiment of the invention have been modified in two respects. First, each of the slots has a narrow milled groove 434 along inner guide edge 436, and it extends slightly to the front or entrance of the slot. This groove is approximately a 0.02 inch deeper recess than that of each slot and is one means of insuring that the inner edge of each slot is precisely vertical and cut clean up at least the level of the release slot recesses, which is important for the precise release of coins. Second, the slots are curved outward in a reverse curvature to that of the periphery of stationary disc 16. The entrance edge of each slot commences at the approximate intersection with a radial line extending from center point 352 of rotating disc 10 to the inner edge of each slot, and the slot continues circularly about a radius of approximately six inches, for a 13-inch disc, which radius has a center (not shown) lying on the reference radial line.

Because the direction of each slot extends outboard of the circumferential movement of coins on pad 27, coins such as 441 and 443 in FIG. 16, are caused to move through appropriate coin release slots in biased engagement with inner edges 436 of the slots. This causes coins to exit slots along a straight line, as illustrated by coins **441*a* and 443*a* in FIG. 16. Straight line exiting facilitates the detection (for counting) and capture of coins from discrete exits in separate containers. While straight line exiting of coins from each slot may be achieved by the straight slots 50, 52, 54 and 56 shown in FIG. 3, curved coin slots require less angular space about the sorter, enabling a greater number of slots to be accommodated and thus the sorting of a greater variety of different diameter coins. Discrete counters 450**, e.g., of photoelectric or proximity types, are positioned adjacent the exit paths of each coin to count exiting coins.

In operation, coins deposited through hopper 30 (FIG. 22) on pad 27 are moved outward by centrifugal force. Referring to FIG. 11, normally there is a continuous flow of coins onto guide edge 372 where the coins are formed in a single layer and single file. At this point, coins are radially restrained and are caused to follow the spiral path provided by track 380, which causes the coins to be directed to ramp 378. Assuming that all of the coins are in line, they will be carried down ramp 378 and pass return slot 404 and be fed to gauge slot 414 where, after final radial alignment therein, they are fed onto coin release slots 428–433 for release as previously described. They are then counted by counters 450.

Coins which come to a halt radially short of guide edge 372 but at least radially in line with protrusion 390 are captured by protrusion 390 and rerotated, enabling them to attempt again to normally move to a position along guide edge 372. Referring to FIG. 15, where there is a coin such as coin 440, which is within track 380 but not properly in an in-line position, this coin is captured by slot 404 and moved inboard for rerotation.

Thus, by one of the means provided, all coins are directed onto guide edge 372 and then through track 380 for sorting without encountering obstructions which are likely to trap coins in the sorter or jam the mechanism of the sorter. Coins are moved at adequate but not excessive velocities, and when their movement in one direction is halted or their direction is changed, it is accomplished with a minimum impact on coins.

Figure 23:
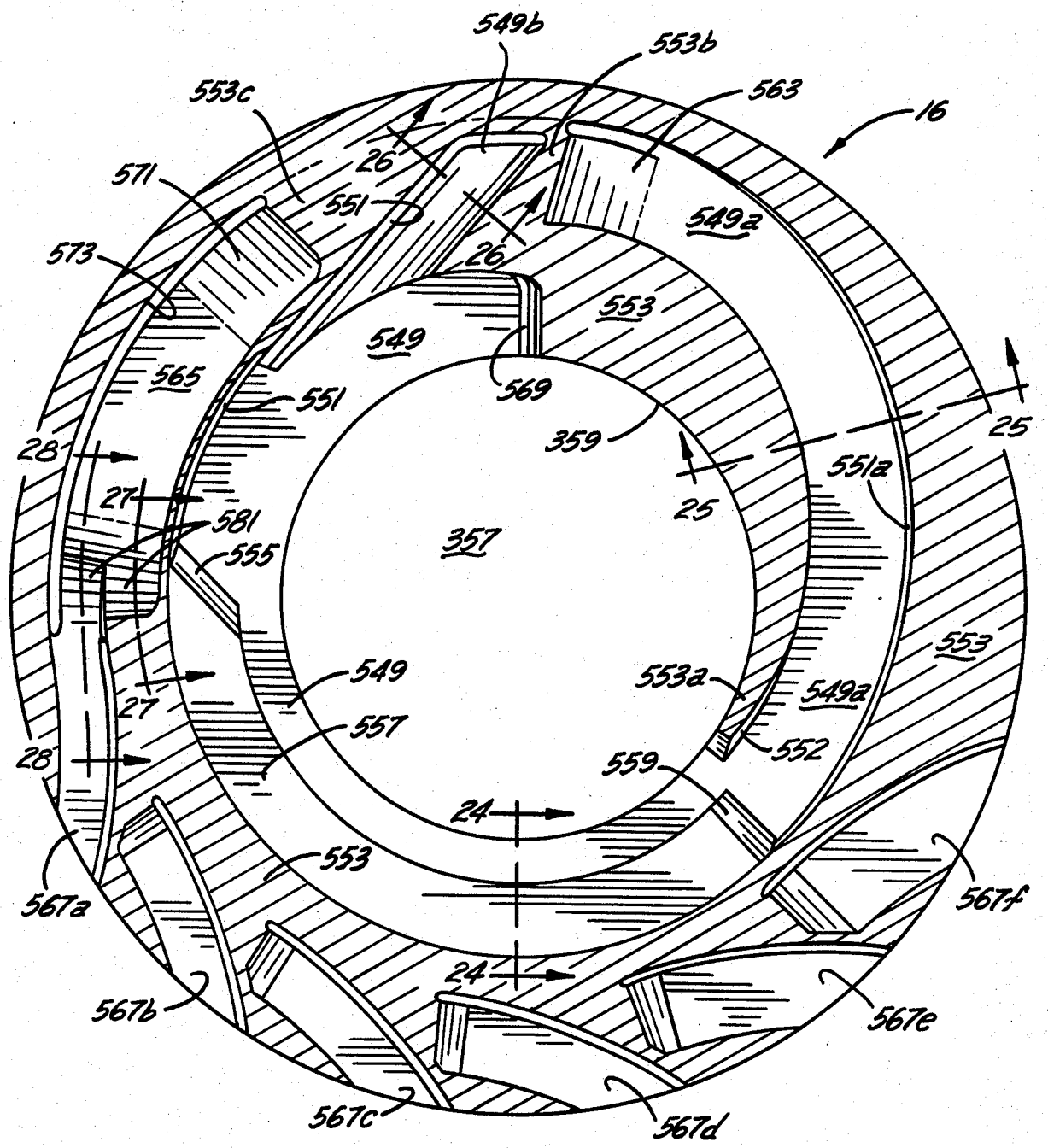
FIG. 23 is a plan view of the underside of the stationary disc of the coin sorter, according to a fifth embodiment.

FIG. 23 is a plan view of the underside of the stationary disc 16 with ridges and recesses according to a fifth embodiment. To facilitate an understanding of the coin movement, the lowermost surface 553 of the stationary disc has been cross-hatched in FIG. 23 to serve as a reference plane for the recesses in the disc. The non-cross-hatched areas of the statonary disc correspond to recessed areas of various depths. The ridge region 553 is coplanar and occupies a large portion of the underside of the stationary disc. In order to press coins into the resilient pad, this coplanar ridge region is the stationary disc surface closest to the surface of the rotating pad.

But the ridge region 553 does not touch the rotating resilient pad since direct contact by the stationary disc would degrade the pad surface. To ease understanding of the embodiment shown in FIG. 23, ridges and recesses located at different areas on the surface of the stationary disc, but having a coplanar surface, have been identified by a common numeric designation and individual alpha designations (e.g., 549, 549*a*, 549*b*).

Figure 24:
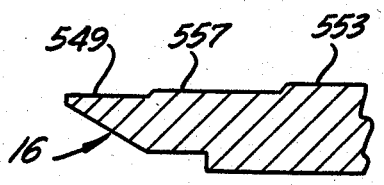
FIG. 24 is a sectional view taken along line 24—24 in FIG. 23.

As can be seen in FIG. 23, the stationary disc 16 has a recess 549 which first receives the coins under the surface of the disc. In order to insure that all denominations of coins enter the recess 549, the depth of the recess is enough to accept one layer of the thickest coin. As the coins are accepted into the recess 549 they are being carried on the pad surface in a counterclockwise orbit, as viewed in FIG. 23, about the center of the rotating disc while simultaneously moving radially over the pad surface toward the disc periphery. Radial movement of the coins is limited by the outer edge 551 of the recess 549. As the coins follow the edge 551, they rotate into a recess 557 by way of wedge 555, with the recess 557 having a depth less than that of recess 549 as can be seen in FIG. 24.

In accordance with one important aspect of the invention, the recess 557 ensures that only a single layer of coins enters into the area between the two discs. It can occur that some of the thinner denomination coins enter recess 549 stacked upon one another. The wedge 555, which is a transition from a relatively deep recess 549 to a shallower recess 557, sweeps off coins which have entered recess 549 on the top of other coins or bridged between an adjacent coin's top surface and the pad surface. In order for those coins swept off others may be returned to the center of the stationary disc for recirculation, the wedge 555 is angled cicumferentially so as to direct the coins radially inwardly. The wedge 555, and the recess 557 following it, press most of the coin denominations into the pad in the process of sweeping their surfaces clean of other coins. The recess 557 needs to be sufficiently shallow to ensure that the wedge 555 sweeps clean the thinnest denomination coin. As a consequence of this, some of the thicker denomination coins are pressed into the pad by the recess 557.

Coins are carried by the rotating disc 10 along the arcuate length of the recess 557 until the recess transits to the depth of recess 549*a* by way of ramp 559. At this point, with portions of ridge 553 on either side of recess 549*a*, the recess and ridge form a channel which captures those coins which have been held by recess 557 as can be seen by the cross-section in FIG. 25. Recesses 549 and 549*a* are deep enough to allow free radial movement for all denominations of coins. In the recess 549*a* the coins are guided by edge 551*a* which defines the proper radial position of the coins bearing thereagainst.

In accordance with another important aspect of the invention, the width of the recess 549*a* is approximately equal to the diameter of the largest coin thereby ensuring proper alignment of the largest diameter coins within the recess 549*a*. Often the largest diameter coins have their inside edges in close proximity to the inside edge of recess 549*a*. To ensure that these large diameter coins do not stick against the inside edge of the recess (because of the slight wedging action caused by the recess edges being slightly less than vertical) and hence misaligned, the width of the recess is made approximately equal to the largest coin denomination diameter. The inside edge of recess 549*a* includes a tapered area 552 to facilitate entry into the recess by the large coins. Proper radial alignment is important for correct sorting of the coins by recesses which subsequently receive the coins from the recess 549*a*. By providing recess 549*a* with a width only slightly greater than the largest diameter coin denomination, a coin of the largest diameter is assured to have its radially outer edge correctly positioned against edge 551*a* of the recess 549*a*.

Figure 25:
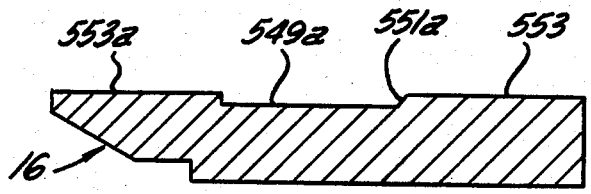
FIG. 25 is a sectional view taken along line 25—25 in FIG. 23.

To reduce coin bounce and coin wear, the edges 551 and 551*a* are angled at approximately a 45° slope, as illustrated in FIG. 25, between the recesses 549, 549*a* and the ridge 553. As can be appreciated from a study of FIG. 25, this bevelling of the edges serves to act as a wedge which directs the coin into a pressed engagement with the pad surface in response to the centrifugal force acting on the coin to move it radially outward. The wedging action of the bevelled edges serve to damp the radial movement of the coins without causing bouncing of the coins on the pad surface, thus achieving more precise radial positioning of the coins in recess 549*a*.

In accordance with another important aspect of the invention coins, not properly aligned by edge 551, will rotate with the rotating disc 10 and be intercepted by a ridge before entering recess 549*a*. Ridge 553*a* presses the improperly aligned coins into the resilient pad 27 and prevents those coins from moving radially. The coins thus move with the rotating disc under ridge 553*a* in a circular counterclockwise arc until ramp 569 releases the coins into region 549 again; as described previously, recess 549 releases the coins from pressed engagement with the pad so that the coins free are to move into engagement with 551. Thus a coin released by ramp 569 will move radially outward under the influence of centrifugal force so that it can be properly guided by edge 551 into wedge 555 and recess 557. Now the coin is on the correct path to properly enter recess 549*b*.

At the end of recess 549*a* the coins are again pressed into the resilient pad 27 by a wedge 563 which is an incline bridging the depth level of recess 549*a* with the ridge 553. As the coins are carried by the rotating disc 10, the coins are steadily pressed into the resilient pad 27 as they are moved under the gradual incline of the wedge 563. Since the coins are pressed into the pad, the coins cannot move radially in response to centrifugal force. Instead the coins follow a path of constant radius. Even though the coins pass over recess 549*b*, some portion of each coin is always in contact with the ridges 553*b* or 553*c* (the cross-hatched area). As the coins are held pressed into the pad by the regions 553*b* and 553*c*, the coins rotate into recess 565. The transition between ridge 553*c* to recess 565 is by way of a ramp 571.

Properly aligned coins will rotate past the recess 549*b* and enter recess 565 as described above. It can occur that a coin of a diameter less than the width of recess 549*a* is misaligned relative to the outside edge of the recess 549*a*. As an example, adjacent coins could prevent a coin from moving out radially to meet the outer edge of the recess 549*a*. If this misalignment were not corrected, the coin could be carried under ridge 553 along an incorrect path for proper sorting, which could result in the coin improperly exiting from one of the recesses 567*a*–567*f*, or possibly not exiting at all and jamming the machine.

In accordance with yet another important aspect of the invention, to solve the misalignment problem, the recess 549b is provided along the path of the coins as they pass out of recess 549a. Both misaligned and correctly aligned coins will be pressed into the resilient pad 27 by wedge 563 and held in pressed engagement with the pad by the ridge 553b. Correctly aligned coins will be kept pressed into the pad by the ridge 553c as they pass recess 549b. Since misaligned coins are located at a radial position spaced inwardly from that of correctly aligned coins, however, the outer edges of the former do not stay under a portion of ridge 553. Therefore, the misaligned coins are released from pressed engagement with the resilient pad 27 by the recess 549b. Once the coins are released from the pad they are free to move radially, and the outside edge 551 of the recess 549b guides the coins back into recess 549 for another attempt at proper alignment within recess 549a.

Figure 26:
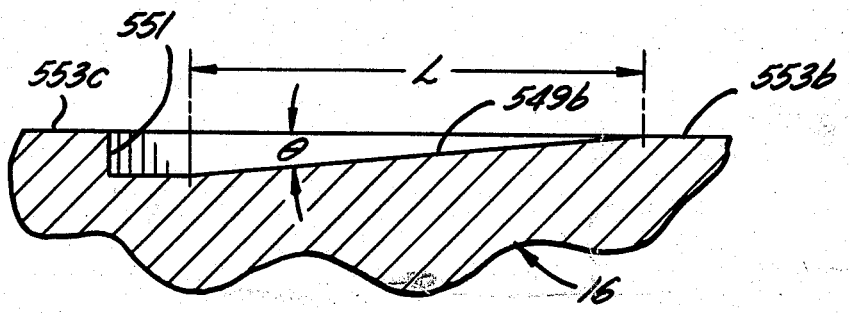
FIG. 26 is a sectional view taken along line 26—26 in FIG. 23.

As shown in FIG. 26 the transition between the planar portion of the recess 549b and the ridge 553b is characterized by a slope of angle $\theta$. Preferably, the angle $\theta$ is as large as possible in order to facilitate the rapid exit of misaligned coins from the recess 549b along edge 551 and back to recess 549. Since the bottom of the recess 549b is at a fixed level (i.e., coplanar with recess 549) and ridge 553b is at a fixed level, any enlargement of the angle $\theta$ in FIG. 26 requires the length L to be reduced. Consequently, the degree of slope in the transition from ridge 553b to recess 549b is limited by the required overall width L. Width L of the recess 549b must be sufficient to free enough of a misaligned coin from pressed engagement with the pad 27 so as to allow relatively easy movement of the coin along edge 551, which guides the coin back to recess 549. Therefore, the width L of the recess 549b need only be sufficient to successfully free enough of the surface of a misaligned coin so as to allow the coin to smoothly and quickly exit the sorting path as guided by edge 551. Because the width of recess 549a is approximately the same as the diameter of the largest diameter coin, a coin of such diameter which reaches the area of recess 549b is always properly aligned; consequently, the recess width L need only be sufficient to accommodate the second largest coin diameter.

Coins which have been correctly aligned against edge 551a in recess 549a pass the area of recess 549b and enter the recess 565 by way of the ramp 571. The depth of recess 565 is sufficient to free all denominations of coins to move radially outwardly to edge 573 so that the radial inner edge of each denomination (each denomination has a unique diameter) is located at a radius unique for each particular denomination. Consequently, the coins leave recess 565 aligned in denominationally discrete radial locations.

From the recess 565 the pad rotation carries the coins into an area of the stationary disc which has a series of recess 567a–567f for allowing properly sized and radially positioned coins to exit from between the discs. Each of the recesses 567a–567f acts as an exit chute for a particular coin denomination by releasing that particular coin from pressed engagement with the pad 27. After the coins have been released from the pad, they are free to move radially along the recess and exit into a coin receptacle.

As mentioned, since all denominations have their outer edges guided to the same radial position by edge 573, it is only the coin inner edge which is at a unique radial position for each denomination. Therefore, the associated recesses 567a–567f which allow the different coins to exit from between the discs must be arranged on the stationary disc so that the coins pass under them in an order of ascending width. To accomplish this, the recesses 567a–567f are arranged in a counterclockwise order of ascending width.

Figure 27:
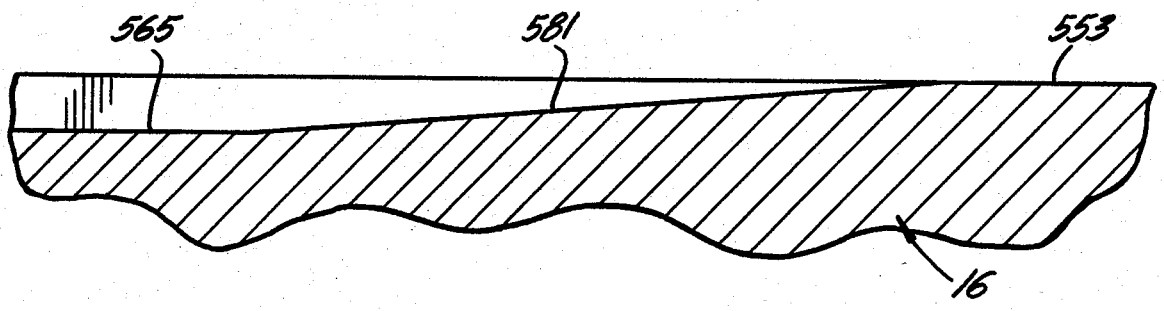
FIG. 27 is a sectional view taken along line 27—27 in FIG. 23.

Most coins leaving recess 565 are carried under wedge 581 and pressed into the pad surface by ridge 553. FIG. 27 shows wedge 581 in cross-section. The wedge 581 provides a transitional slope of constant angle between the recess 565 and the ridge 553. As long as a coin is pressed into the pad by ridge 553 it will be carried on the pad at a fixed location and will rotate under the recesses and ridges of the stationary disc at a constant radial position (circular orbit) as determined by the recess 565 in which the coin was last allowed to move radially. Therefore as long as a coin has any portion of its surface under ridge 553 as its orbit passes recesses 567a–567f it is restrained against radial movement. In this orbit, a coin is carried under a series of ramps which are the transitions between ridge 553 and the recesses 567a–567f. The radial position of the coin orbit places the path of the coin entirely within the appropriate ramp and recess. Thus when the appropriate ramp and recess is reached, the coin is no longer held pressed into the resilient pad by ridge 553 and, since recesses 567a–567f are deeper than the thickness of the coins, the coin is free to move radially along the recess edge. All the coins of each denomination are collected in a corresponding receptacle which catches the coins as they leave the region between the two discs by way of the recesses 567a–567f. If desired, a mechanical or electrical counter can be fixed proximate to the exit of the coins in order to detect and count the number of coins sorted.

Figure 28:
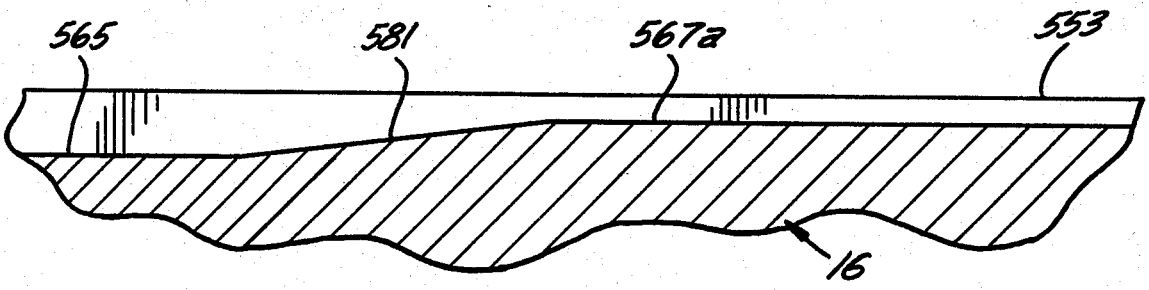
FIG. 28 is a sectional view taken along line 28—28 in FIG. 23.

In accordance with still another important aspect of the invention, the transition from recess 565 to the recess 567a is without a return to the level of ridge 553. As the cross-section in FIG. 28 shows, the transition between recess 565 and recess 567a is through wedge 581. The wedge 581, however, does not reach the level of ridge 553 before the beginning of recess 567a. The transition between recess 565 and recess 567a allows coins exiting through recess 567a (the smallest diameter coin) to enter the recess 567a smoothly and without coin bounce which might otherwise occur if the coins were first pressed into the resilient pad by ridge 553 before entering recess 567a. By smoothly transferring from recess 565 to recess 567a, coins exit through recess 567a quickly and with little wear to the coin or to the recess.

In summary, it will be appreciated from the foregoing description that the coin sorter of the invention utilizes a simple construction to economically sort mixed denominations of coins. Also, the coin sorter operates at a high sorting speed without causing excessive wear to the coins or to the sorter apparatus. In addition, it will be appreciated from the foregoing description that the coin sorter of the invention is relatively immune from jamming, therefore requiring few repairs and only periodic maintenance. Consequently, the coin sorter requires very little down time in a heavy use environment.

It is claimed:

1. A coin sorter apparatus for receiving and sorting mixed coins by denomination, said apparatus comprising:

a rotating disc having a resilient surface for receiving said mixed denomination coins and imparting a rotational movement to said mixed denomination coins, a stationary disc having ridges and recesses on its underside and being proximate to said resilient surface of said rotating disc, a first area of ridges and recesses on the underside of said stationary disc for receiving the rotating mixed denomination coins into the region between the two discs, a second area of ridges and recesses on the underside of said stationary disc for removing coins stacked or shingled on another coin, a third area of ridges and recesses on the underside of said stationary disc for receiving coins from said second area and said recesses in said third area having regions for releasing coins from a pressed engagement with said resilient surface and thereby permitting radial movement of coins within said regions by centrifugal force, and said regions being shaped to guide coins in a single file along a predetermined path to predetermined radial positions on the rotating disc, and a fourth area of ridges and recesses on the underside of said stationary disc for receiving coins from said third area and effecting a pressed engagement with said rotating disc and with said recesses of said fourth area releasing coins in said fourth area from pressed engagement and being shaped to permit coins of different sizes to escape radially from between the two discs, by centrifugal force, at different preselected positions along the periphery of said stationary disc.

2. A coin sorter apparatus for receiving and sorting mixed coins by denomination as set forth in claim 1 wherein said third area of ridges and recesses on the underside of said stationary disc includes a first recess having a width approximately equal to the largest diameter coin denomination, whereby coin denominations of the largest diameter are urged by the inner edge of said first recess against the outer edge of said first recess.

3. A coin sorter apparatus for receiving and sorting mixed coins by denomination as set forth in claim 1 including in said first, second and third areas of ridges and recesses circumferential transitions between said ridges and recesses with said transitions having a gradient less than 90° so as to create a wedge-shaped transition which reduces coin bounce within said recesses.

4. A coin sorter apparatus for receiving and sorting mixed coins by denomination as set forth in claim 1 wherein a first recess in said fourth area of ridges and recesses extends into said third area of ridges and recesses to provide a transition from said third area to said fourth area for the smallest denomination coin which does not press said denomination into the resilient surface.

5. A coin sorter apparatus for receiving and sorting mixed coins by denomination as set forth in claim 4 including transitions between said ridges and recesses which function to guide coin movement and define wedge-shaped transitions between the recess in which the coins travel and the adjacent ridge, with said transitions reducing coin bounce within said recesses.

6. A coin sorter apparatus for receiving and sorting mixed coins by denomination as set forth in claim 5 wherein said third area of ridges and recesses on the underside of said stationary disc includes a first recess having a width approximately equal to the largest diameter coin denomination, whereby coin denominations of the largest diameter are urged by the inner edge of said first recess against the outerr edge of said first recess.

7. A coin sorter apparatus for receiving and sorting mixed coins by denomination, said apparatus comprising:

a rotating disc having a resilient surface for receiving said mixed denomination coins and importing a rotational movement to said mixed denomination coins, a stationary disc having ridges and recesses on its underside and being proximate to said resilient surface of said rotating disc, a first area of ridges and recesses on the underside of said stationary disc for receiving the rotating mixed denomination coins into the region between the two discs, a second area of ridges and recesses on the underside of said stationary disc for receiving coins from said first area and said recesses in said second area having regions for releasing coins from a pressed engagement with said resilient surface and thereby permitting radial movement of coins within said regions by centrifugal force, and said regions being shaped to guide coins in a single file along a predetermined path to predetermined radial positions on the rotating disc, a third area of ridges and recesses on the underside of said stationary disc for receiving coins from said second area and effecting a pressed engagement with said rotating disc and with said recesses of said third area releasing coins in said third area from pressed engagement and being shaped to permit coins of different sizes to escape radially from between the two discs, by centrifugal force, at different preselected positions along the periphery of said stationary disc, and a first recess in said third area of ridges and recesses extending into said second area of ridges and recesses to provide a transition from said second area to said third area for the smallest denomination coin wherein said transition does not press said smallest denomination into the resilient surface.

8. A coin sorter apparatus for receiving and sorting mixed coins by denomination, said apparatus comprising:

a rotary disc having a resilient surface for receiving said mixed denomination coins and inparting a rotational movement to said mixed denomination coins, a stationary disc having ridges and recesses on its underside and being proximate to said resilient surface of said rotating disc, a first area of ridges and recessed on the underside of said stationary disc for receiving the rotating mixed denomination coins into the region between the two discs, a second area of ridges and recesses on the underside of said stationary disc for receiving coins from said first area and said recesses in said second area having regions for releasing coins from a pressed engagement with said resilient surface and thereby permitting radial movement of coins within said regions by centrifugal force, and said regions being shaped to guide coins in a single file along a predetermined path to predetermined radial positions on the rotating disc, a third area of ridges and recesses on the underside of said stationary disc for receiving coins from said second area and effecting a pressed engagement with said rotating disc and with said recesses of said third area releasing coins in said third area from pressed engagement and being shaped to permit coins of different sizes to escape radially from between the two discs, by centrifugal force, at different preselected positions along the periphery of said stationary disc, and circumferential transitions between said ridges and recesses having a gradient less than 90° so as to create a wedge-shaped transition which reduces coin bounce within said recesses.

9. A coin sorter apparatus for receiving and sorting mixed coins by denomination, said apparatus comprising:

a rotating disc having a resilient surface for receiving said mixed denomination coins and imparting a rotational movement to said mixed denomination coins, a stationary disc having ridges and recesses on its underside and being proximate to said resilient surface of said rotating disc, said stationary disc having a central opening for receiving on said resilient surface said mixed coins of which there are coins shingled or stacked upon other coins, a coin separator means adjacent said central opening comprising an elastomer surface substantially parallel with said resilient surface with said elastomer surface serving to retard movement on said resilient surface of said shingled or stacked coins such that the shingled or stacked coins are swept from the surface of the other coins, a first area of ridges and recesses on the underside of said stationary disc for receiving the rotating mixed denomination coins into the region between the two discs from said central opening and said coin separator means, a second area of ridges and recesses on the underside of said stationary disc for receiving coins from said first area and said recesses in said second area having regions for releasing coins from a pressed engagement with said resilient surface and thereby permitting radial movement of coins within said regions by centrifugal force, and said regions being shaped to guide coins in a single file along a predetermined path to predetermined radial positions on the rotating disc, and a third area of ridges and recesses on the underside of said stationary disc for receiving coins from said second area and effecting a pressed engagement with said rotating disc and with said recesses of said third area releasing coins in said third area from pressed engagement and being shaped to permit coins of different sizes to escape radially from between the two discs, by centrifugal force, at different preselected positions along the periphery of said stationary disc.

10. An apparatus for sorting coins of different denominations, said apparatus comprising;

a rotatable member having a resilient surface, a stationary member having a surface that is substantially parallel to said resilient member and positioned sufficiently close to said resilient surface so that at least portions of the stationary surface press any coins in contact therewith and to the opposed resilient rotatable surface so that the resiliency of the rotatable surface urges the coins against the stationary surface with sufficient pressure to prevent radial movement of the coins by centrifugal force due to rotation of the rotatable member, while permitting circumferential movement of the coins by rotation of the rotatable member, and selected areas of the surface of said stationary member being recessed for releasing any coins entering any such recessed areas from the pressure of said resilient surface and thereby permitting radial movement of coins within the recessed areas by centrifugal force due to rotation of the rotatable member, said recessed areas being shaped to (1) unstack coins into a single layer distribution, and (2) guide coins in single file along a predetermined path and (3) permit coins of different sizes to escape radially by centrifugal force from between the members at different predetermined positions around the periphery of the stationary member.

11. A coin sorter for sorting different denominations of coins comprising:

a rotatable member having a resilient surface;

an annular stationary member having a surface substantially parallel with said resilient surface and positioned sufficiently close to said resilient surface so that a portion of the stationary surface presses coins in contact therewith into the opposed resilient rotatable surface so that the resiliency of the rotatable surface urges the coins against the stationary surface with sufficient pressure to prevent radial movement of coins by centrifugal force due to rotation of the rotatable member, while permitting circumferential movement of the coins by rotation of the rotatable member;

a central opening in said annular stationary member for permitting said rotating member to receive coins of mixed denominations and said central opening defining an inner edge of said annular stationary member;

selected areas of the surface of said stationary member being recessed for releasing any coins entering such recessed areas from the pressure of said resilient surface and thereby permitting radial movement of coins within the recessed areas by centrifugal force due to rotation of the rotatable member, said recessed areas being shaped to first guide coins outwardly in single file along a predetermined path, and second, to permit coins of different sizes to escape radially from between said surfaces by centrifugal force at different preselected positions along the periphery of said stationary member;

a coin separating means comprising an arcuate shaped elastomer member located adjacent said inner edge of said stationary member and having a lower resilient surface in a plane generally parallel with the resilient surface of said rotatable member; whereby the top of two shingled coins, carried on the resilient pad, is engaged by and retarded in movement by said elastomer member to cause the lower of the shingled coins to be carried free of the top coin.

* * * * *